US011828091B2

(12) United States Patent
Han et al.

(10) Patent No.: US 11,828,091 B2
(45) Date of Patent: Nov. 28, 2023

(54) STRUCTURE TO PREVENT DOOR OPENING IN VEHICLE COLLISION

(71) Applicants: Hyundai Motor Company, Seoul (KR); Kia Motors Corporation, Seoul (KR)

(72) Inventors: Jungho Han, Seoul (KR); Jinwoo Nam, Seoul (KR); Kyoung Taek Kwak, Yongin-si (KR); Dong Jun Kim, Bucheon-si (KR); Do Won Sung, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 456 days.

(21) Appl. No.: 17/216,007

(22) Filed: Mar. 29, 2021

(65) Prior Publication Data

US 2022/0074238 A1 Mar. 10, 2022

(30) Foreign Application Priority Data

Sep. 4, 2020 (KR) ..... 10-2020-0113303

(51) Int. Cl.
*E05B 77/06* (2014.01)
*E05B 85/16* (2014.01)

(52) U.S. Cl.
CPC ..... *E05B 77/06* (2013.01); *E05B 85/16* (2013.01)

(58) Field of Classification Search
CPC ..... E05B 1/0015; E05B 77/06; E05B 85/16; A47B 95/02; B25G 3/12
USPC ..... 16/110.1, 412
See application file for complete search history.

(56) References Cited

U.S. PATENT DOCUMENTS 6,648,382 B1 * 11/2003 Monig ..... E05B 77/06 292/336.3
7,481,468 B2 * 1/2009 Merideth ..... E05B 77/06 292/183
8,152,209 B2 * 4/2012 Lee ..... E05B 77/06 292/336.3
8,366,159 B2 * 2/2013 Patel ..... E05B 77/06 292/336.3
8,840,156 B2 * 9/2014 Savant ..... F16B 12/40 292/336.3
9,574,381 B2 * 2/2017 Beck ..... E05B 85/14
9,637,949 B2 * 5/2017 Niegeloh ..... E05B 7/00
9,637,956 B2 * 5/2017 Niegeloh ..... E05B 85/16
9,856,675 B2 * 1/2018 Ilardo ..... E05B 7/00
(Continued)

*Primary Examiner* — Roberta S Delisle
(74) *Attorney, Agent, or Firm* — MORGAN, LEWIS & BOCKIUS LLP

(57) ABSTRACT

A structure of preventing door opening in vehicle collision may include a handle housing including a housing stopper, a door handle rotatably mounted around a door handle rotation axis on the handle housing, and of which a rotation contact end portion formed at one end portion thereof, and a blocking lever assembly including a blocking lever rotatably coupled to the handle housing and having an inertia portion formed on a portion of the blocking lever, and an assist lever selectively protruded from the blocking lever, wherein, when the blocking lever assembly is rotated by an external impact applied to the blocking lever assembly, the assist lever protrudes out of the blocking lever to be caught by the housing stopper and positioned in a movement path of the rotation contact end portion.

13 Claims, 11 Drawing Sheets

(56) References Cited

U.S. PATENT DOCUMENTS

| | | | | |
|---|---|---|---|---|
| 10,077,581 | B2 * | 9/2018 | Ilardo | E05B 85/16 |
| 10,273,728 | B2 * | 4/2019 | Nam | E05B 77/06 |
| 2008/0136199 | A1 * | 6/2008 | Kim | E05B 77/06<br>292/340 |
| 2014/0361556 | A1 * | 12/2014 | Beck | E05B 85/10<br>292/336.3 |
| 2014/0367977 | A1 * | 12/2014 | Beck | E05B 85/14<br>292/336.3 |
| 2014/0375068 | A1 * | 12/2014 | Niegeloh | E05B 7/00<br>292/336.3 |
| 2014/0375069 | A1 * | 12/2014 | Niegeloh | E05B 77/06<br>292/336.3 |

* cited by examiner

STRUCTURE TO PREVENT DOOR OPENING IN VEHICLE COLLISION

CROSS-REFERENCE TO RELATED APPLICATION

The present application claims priority to Korean Patent Application No. 10-2020-0113303 filed on Sep. 4, 2020, the entire contents of which is incorporated herein for all purposes by this reference.

BACKGROUND OF THE PRESENT INVENTION

Field of the Invention

The present invention relates to a structure of preventing door opening in vehicle collision. More particularly, the present invention relates to a structure of preventing door opening in vehicle collision in which the door opening function may be maintained after preventing the door opening during vehicle collision.

Description of Related Art

In general, a vehicle has a vehicle compartment in which a driver or an accompanying occupant can board it, and a vehicle compartment opening door is provided to open or close the vehicle compartment.

The internal door handle is mounted on the internal side of the door facing the interior of the vehicle so that the vehicle compartment opening door may be easily opened or closed by the occupant, and the outside door handle is mounted on the external surface facing the outside of the vehicle compartment.

Each door handle is connected to interlock with a door latch that fixes the door to the vehicle body, so that the door may be opened by releasing the door latch according to the operation of each door handle.

The outside door handle is usually mounted to enable pivot movement on the external panel of the door, and is provided to protrude outward along the width direction of the vehicle on the door external panel so that the occupant can easily grasp it.

If the outside door handle is provided to protrude outward along the width direction of the vehicle as described above, the operator's operation convenience is improved, but the appearance of the vehicle may deteriorate due to the protruded outside door handle. Furthermore, it can cause driving noise while the vehicle is driving, as well as deteriorated driving performance due to driving resistance.

Recently, to solve the present problem, in some cases, the outside door handle protrudes outward along the width direction of the vehicle from the door external panel by driving the actuator (motor), or is accommodated in the receiving hole formed in the door external panel. As a result, a retractable outside door handle is being developed that does not protrude outside the door external panel.

In the conventional retractable outside door handle assembly, the outside door handle protrudes from the door external panel through an actuator through a link mechanism, or stored in the receiving hole of the door external panel, and the door is locked to the vehicle body. Alternatively, it is connected to a door lock mechanism including a cylinder with a key which may be operated to release it, and a door latch mechanism that directly locks or releases the door to the vehicle body.

However, in the structure of the conventional retractable outside door handle assembly as described above, the flush door handle may not undesirably protrude in the event of a vehicle collision, so that the vehicle door may not be opened. It is necessary to return to normal operation and to develop a device or structure for this.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a structure of preventing door opening in vehicle collision in which the door opening function may be maintained after preventing the door from being opened during vehicle collision.

A structure of preventing door opening in vehicle collision according to various exemplary embodiments of the present invention, the structure of preventing door opening may include a handle housing including a housing stopper, a door handle rotatably mounted around a door handle rotation axis on the handle housing, and of which a rotation contact end portion formed at one end portion thereof, and a blocking lever assembly including a blocking lever rotatably coupled to the handle housing and having an inertia portion formed on a portion of the blocking lever, and an assist lever selectively protruded from the blocking lever, wherein, when the blocking lever assembly is rotated by an external impact applied to the blocking lever assembly, the assist lever protrudes out of the blocking lever to be caught by the housing stopper and positioned in a movement path of the rotation contact end portion.

The blocking lever assembly may further include a lever spring that rotates the blocking lever assembly when the rotation contact end portion presses the assist lever to move the blocking lever assembly out of the movement path of the rotation contact end portion.

The blocking lever assembly may further include an assist lever spring for elastically supporting the assist lever in a predetermined direction.

The blocking lever may have a lever insert portion formed to enable the assist lever to move.

The blocking lever assembly may further include an assist lever guide pin, and the assist lever may have a guide slot into which the assist lever guide pin is inserted.

A blocking stopper may be formed on the blocking lever to limit rotation of the blocking lever assembly in contacting with the handle housing.

The blocking lever assembly may further include a blocking lever protrusion that contacts with the rotation contact end portion when the rotation contact end portion presses the assist lever.

The rotation contact end portion may be formed obliquely.

The blocking lever assembly may further include a lever pin rotatably coupling the blocking lever assembly to the handle housing.

According to the structure of preventing door opening in vehicle collision according to various exemplary embodiments of the present invention, the blocking lever assembly rotates during a vehicle collision to prevent rotation of the door handle, and then the door opening function may be maintained.

Furthermore, effects which may be obtained or predicted by the exemplary embodiments of the present invention will be included directly or implicitly in the detailed description of the exemplary embodiments of the present invention. That is, various effects predicted according to various exemplary embodiments of the present invention will be included within a detailed description to be described later.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
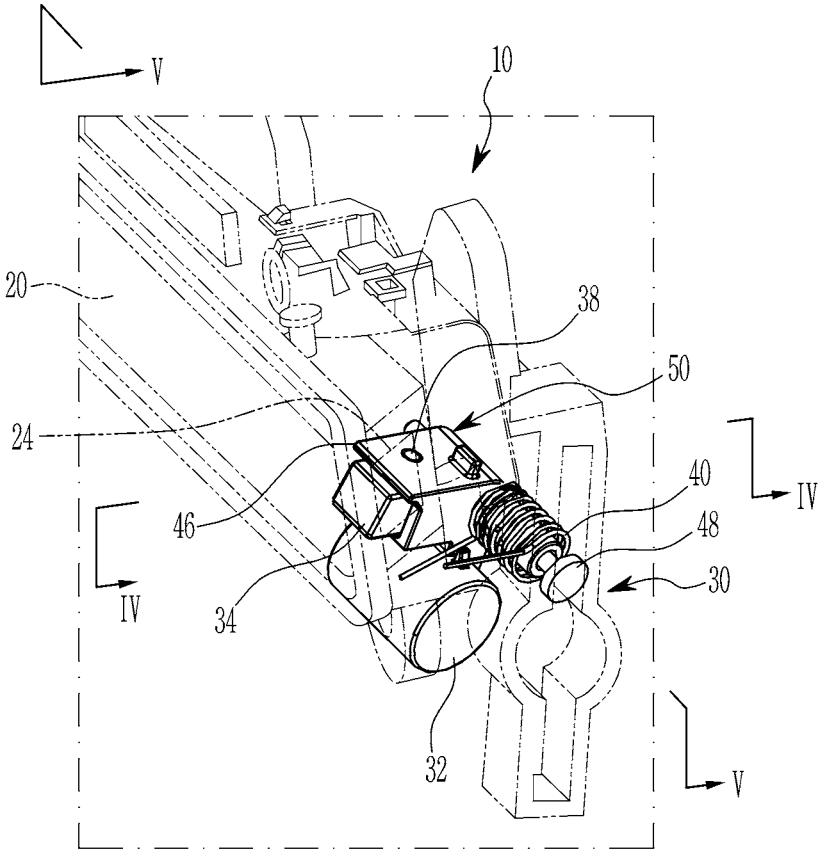
FIG. 1 is a perspective view of a structure of preventing door opening in vehicle collision according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Parts indicated by the same reference numerals throughout the specification mean the same components.

In the drawings, the thickness of layers, films, panels, regions, etc., are exaggerated for clarity.

When a part such as a layer, film, region, or plate is said to be "on" another part, this includes not only the case directly above the other part, but also the case where there is another part in between.

In contrast, when an element is referred to as being "directly on" another element, there are no intervening elements present.

Throughout the specification, when a part "includes" a certain component, it means that other components may be further included rather than excluding other components unless specifically stated to the contrary.

Various exemplary embodiments of the present invention will hereinafter be described in detail with reference to the accompanying drawings.

FIG. 1 is a perspective view of a structure of preventing door opening in vehicle collision according to various exemplary embodiments of the present invention.

Referring to FIG. 1, a structure of preventing door opening in vehicle collision according to various exemplary embodiments of the present invention includes a handle housing 10, a door handle 20 mounted on the handle housing 10 and having a rotation contact end portion 24 formed at one end portion thereof, and a blocking lever assembly 30.

Figure 2:
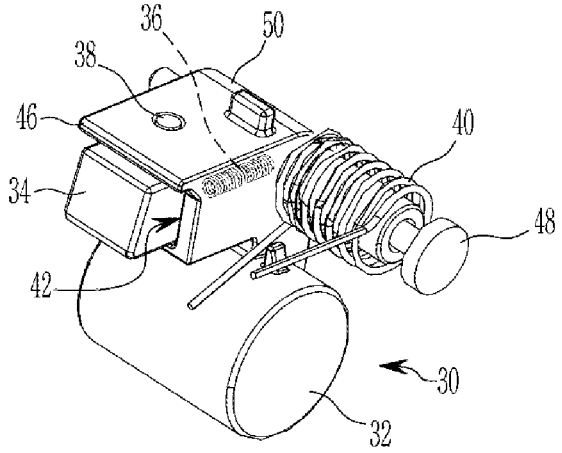
FIG. 2 is a perspective view of a blocking lever assembly of a structure of preventing door opening in vehicle collision according to various exemplary embodiments of the present invention.
Figure 3:
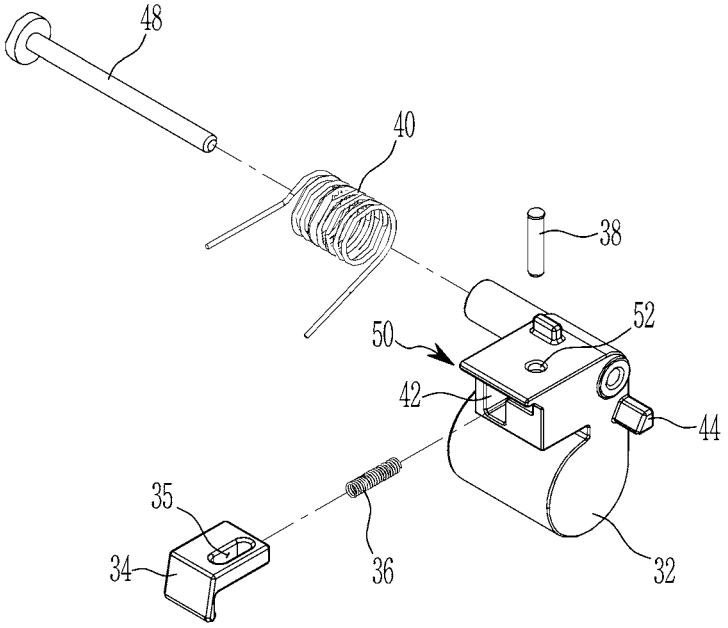
FIG. 3 is an exploded perspective view of the blocking lever assembly of a structure of preventing door opening in vehicle collision according to various exemplary embodiments of the present invention.

FIG. 2 is a perspective view of a blocking lever assembly of a structure of preventing door opening in vehicle collision according to various exemplary embodiments of the present invention, and FIG. 3 is an exploded perspective view of the blocking lever assembly of a structure of preventing door opening in vehicle collision according to various exemplary embodiments of the present invention.

Referring to FIG. 1 to FIG. 3, the blocking lever assembly 30 includes a blocking lever 50 rotatably coupled to the handle housing 10 and having an inertia portion 32 formed therein, and an assist lever 34 selectively protruded from the blocking lever 50.

The blocking lever assembly 30 may further include a lever spring 40 that rotates the blocking lever assembly 30 when the rotation contact end portion 24 presses the assist lever 34.

The blocking lever assembly 30 may further include an assist lever spring 36 elastically supporting the assist lever 34.

The blocking lever assembly 30 may further include a lever pin 48 rotatably coupling the blocking lever assembly 30 to the handle housing 10.

A lever insert portion 42 may be formed in the blocking lever 50 so that the assist lever 34 may be moved therein.

The blocking lever assembly 30 further includes an assist lever guide pin 38, and the assist lever 34 may have a guide slot 35 into which the assist lever guide pin 38 is inserted. A connection hole 52 is formed in the blocking lever 50, and the assist lever guide pin 38 is inserted into the connection hole 52 and the guide slot 35. Therefore, the assist lever 34 is movable within the lever insert portion 42, and is not separated from the blocking lever 50 by the assist lever guide pin 38.

A blocking stopper 44 may be formed on the blocking lever 50 to limit rotation of the blocking lever assembly 30 by contacting with the handle housing 10.

The blocking lever assembly 30 may further include a blocking lever protrusion 46 that contacts with the rotation contact end portion 24 when the rotation contact end portion 24 presses the assist lever 34.

Figure 5:
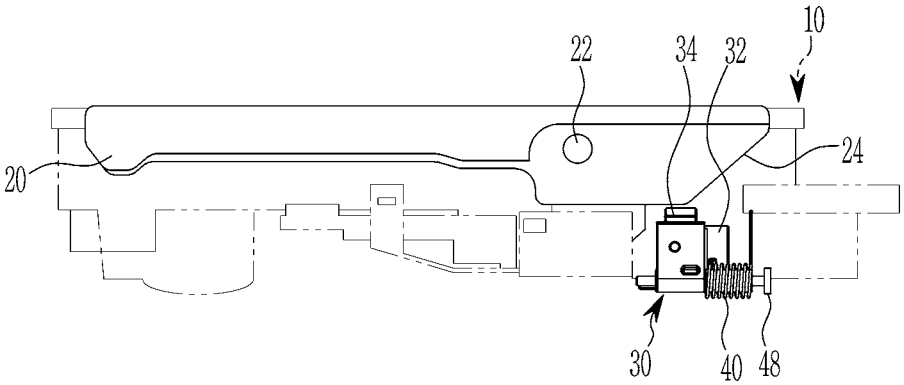
FIG. 5 is a cross-sectional view along line V-V of FIG. 1, showing the setup state.

Referring to FIG. 1 and FIG. 5, the rotation contact end portion 24, which is in contact with the assist lever 34, is formed in an inclined manner so that the assist lever 34 may be pressed smoothly without jamming.

Figure 4:
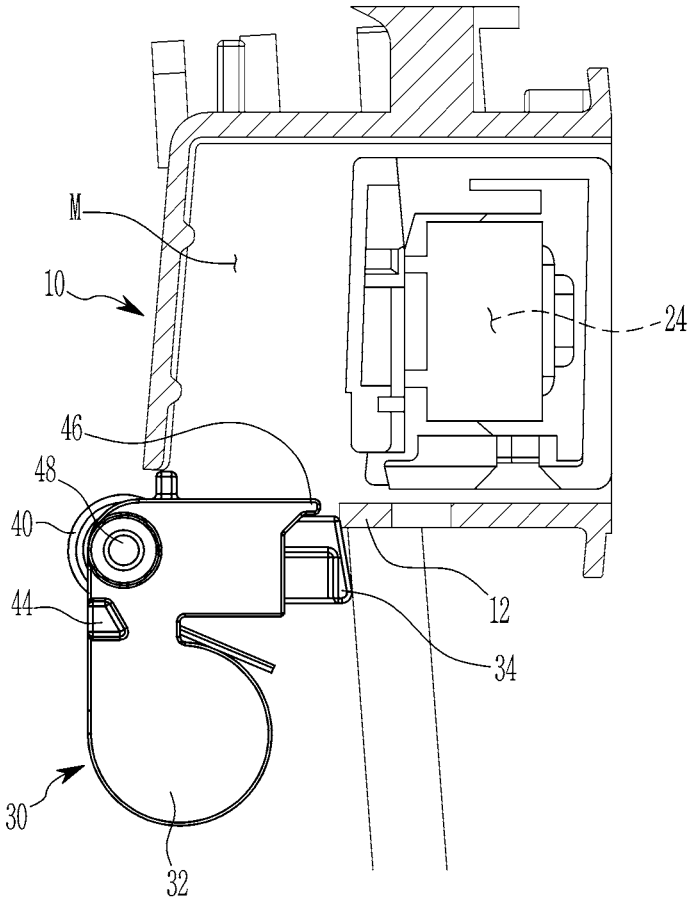
FIG. 4 is a cross-sectional view along line IV-IV of FIG. 1, showing the setup state.

FIG. 4 is a cross-sectional view along line IV-IV of FIG. 1, showing the setup state, and FIG. 5 is a cross-sectional view along line V-V of FIG. 1, showing the setup state.

Figure 6:
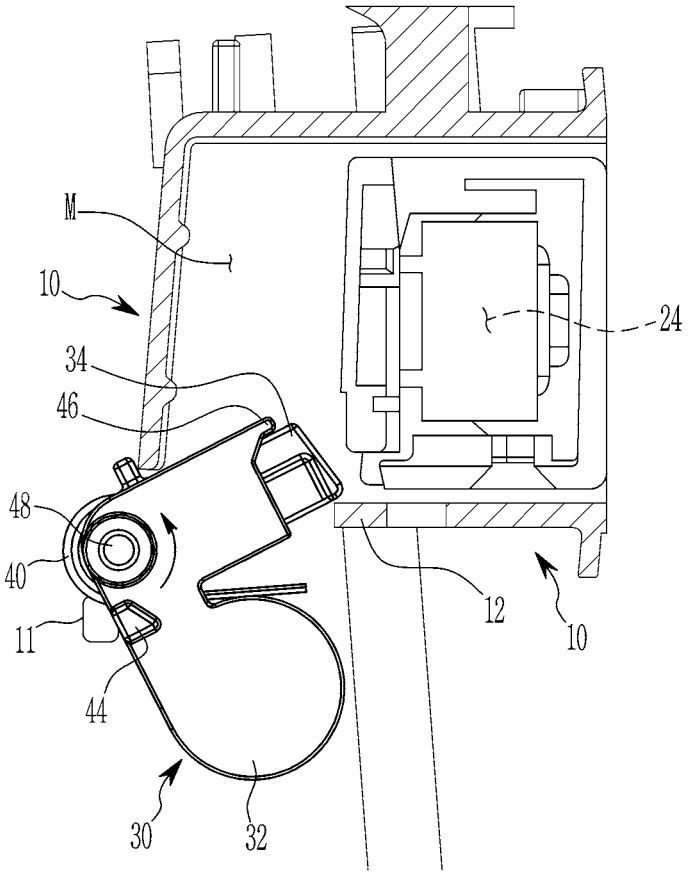
FIG. 6 is a cross-sectional view along line IV-IV of FIG. 1, showing the state after vehicle collision.

FIG. 6 is a cross-sectional view along line IV-IV of FIG. 1, showing the state after vehicle collision.

Referring to FIG. 1 to FIG. 6, a housing stopper 12 is formed on the handle housing 10, and the door handle 20 is rotatably mounted around the door handle rotation axis 22 on the handle housing 10.

A stopper contact portion 11 is formed in the handle housing 10, and the blocking stopper 44 contacts. The state in which the stopper contact portion 11 and the blocking stopper 44 contact by the lever spring 40 is defined as the setup state.

In the setup state shown in FIG. 4 and FIG. 5, when an external impact is applied to the vehicle, the blocking lever assembly 30 rotates.

That is, as shown in FIG. 6, when an external impact occurs, the blocking lever assembly 30 rotates around the lever pin 48 due to the weight of the inertia portion 32. The external impact may be, for example, a side impact of the vehicle, and the amount of impact may be, for example, 30 G or more, but is not limited thereto.

When the blocking lever assembly 30 is rotated by an external impact, the assist lever 34, which was in contact with the housing stopper 12, protrudes by the assist lever spring 36 and is caught by the housing stopper 12, and is positioned in the moving path M of the rotation contact end portion 24.

Figure 7:
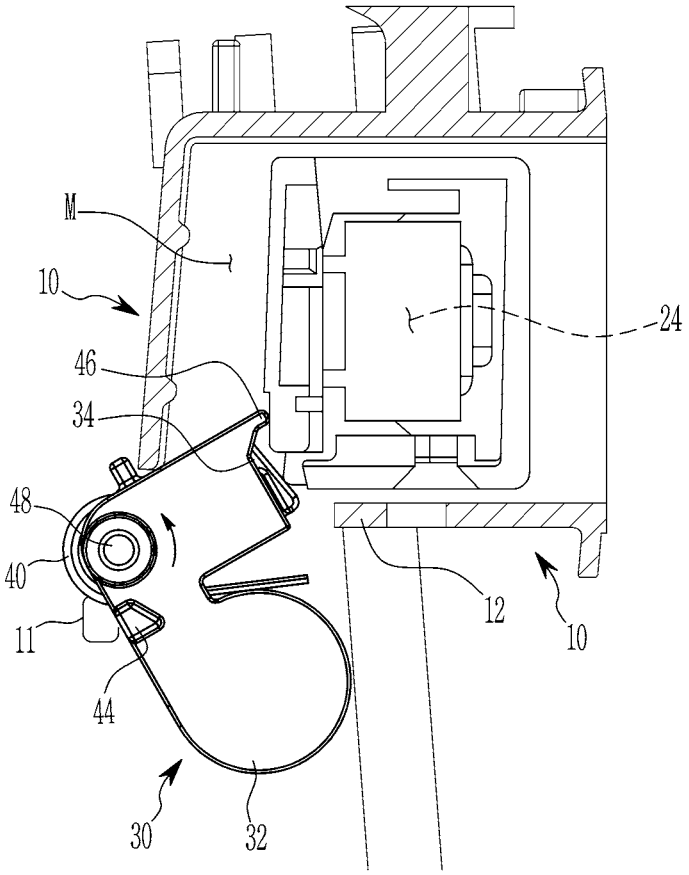
FIG. 7 is a cross-sectional view along line IV-IV of FIG. 1, showing the operation state of the door handle after vehicle collision.
Figure 8:
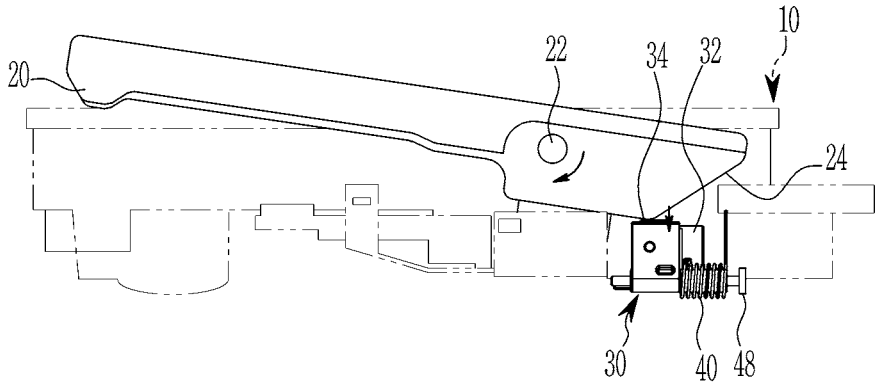
FIG. 8 is a cross-sectional view along the line V-V of FIG. 1, showing the operation state of the door handle after vehicle collision.

FIG. 7 is a cross-sectional view along line IV-IV of FIG. 1, showing the operation state of the door handle after vehicle collision, and FIG. 8 is a cross-sectional view along the line V-V of FIG. 1, showing the operation state of the door handle after vehicle collision.

When the blocking lever assembly 30 is rotated and positioned in the moving path M of the rotation contact end portion 24, it is possible to prevent the vehicle door from being unintentionally opened even if the door handle 20 is rotated. For example, even if the door handle 20 is rotated by impact, the blocking lever assembly 30 prevents the door handle 20 from fully operating.

That is, after the door handle 20 rotates and the rotation contact end portion 24 presses the assist lever 34, the blocking lever protrusion 46 contacts with the rotation contact end portion 24 to prevent additional rotation of the door handle 20.

Figure 9:
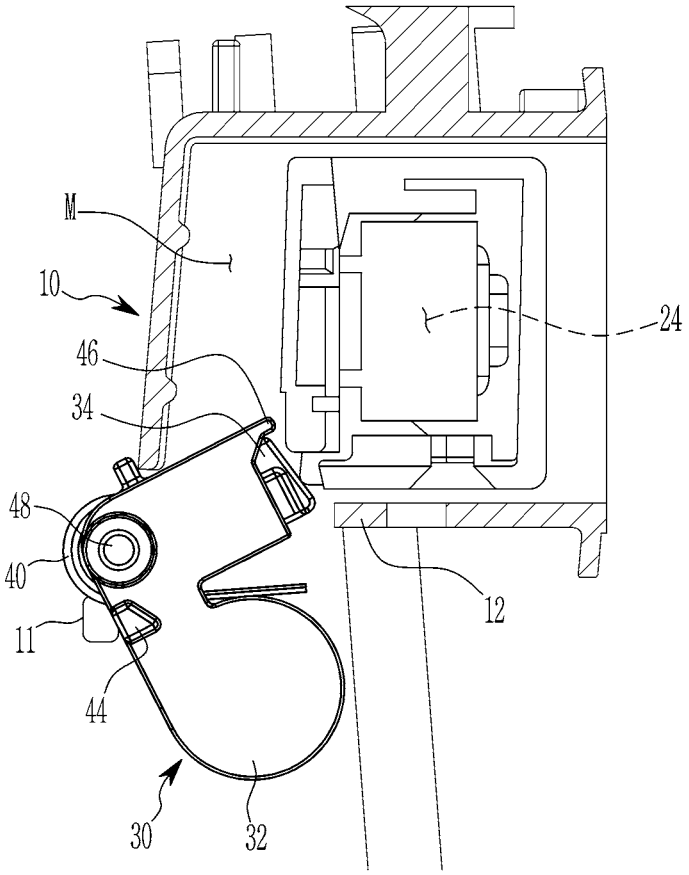
FIG. 9, FIG. 10 and FIG. 11 is a cross-sectional view along line IV-IV of FIG. 1 showing the return operation to the setup state according to the operation of the door handle.
Figure 10:
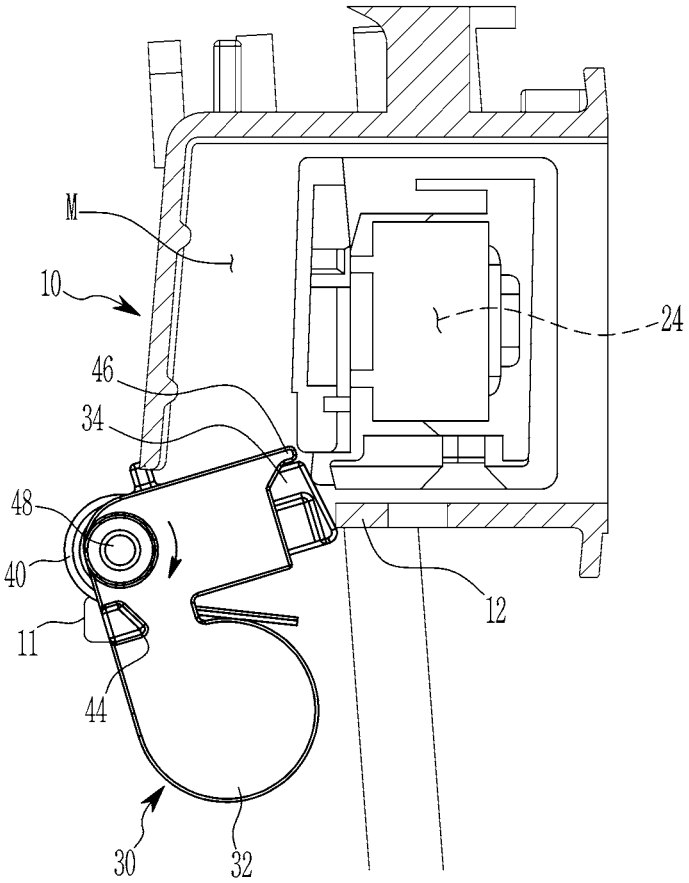
Figure 11:
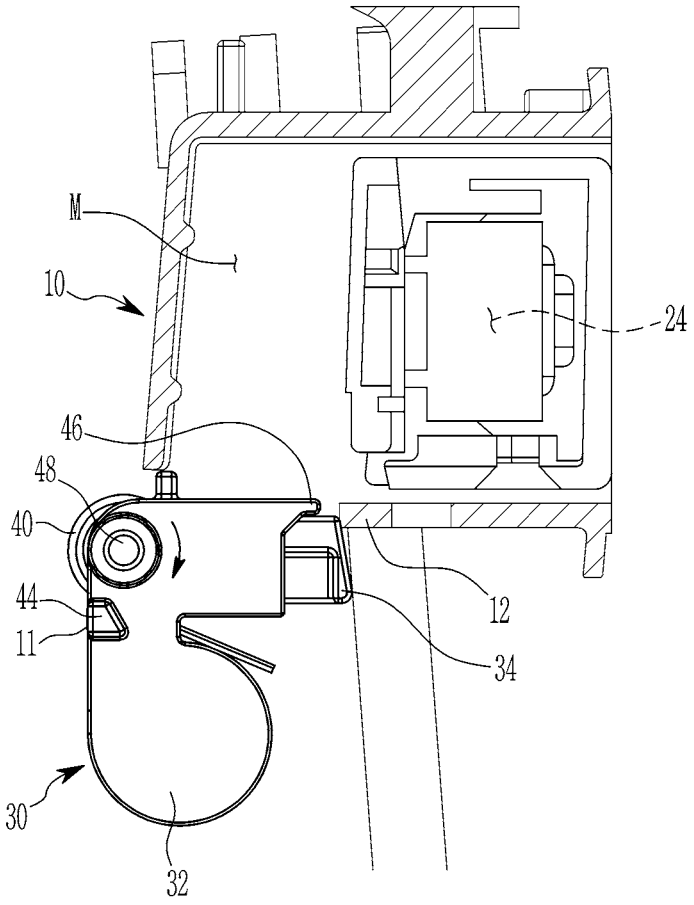

FIG. 9, FIG. 10 and FIG. 11 is a cross-sectional view along line IV-IV of FIG. 1 showing the return operation to the setup state according to the operation of the door handle.

Thereafter, when the external force applied to the door handle 20 is removed or the door handle 20 is in its original position by a door handle spring, the, the blocking lever assembly 30 returns to the setup state by the lever spring 40.

That is, as shown in FIGS. 9 and 10, when the blocking lever assembly 30 rotates by the lever spring 40 while the rotation contact end portion 24 depresses the assist lever 34, the blocking lever assembly 30 is rotated without interference from the housing stopper 12.

And, as shown in FIG. 11, the stopper contact portion 11 and the blocking stopper 44 contact each other, and the blocking lever assembly 30 returns to the setup state.

Thereafter, the blocking lever assembly 30 deviates from the movement path M of the rotation contact end portion 24, and the door handle 20 is fully operable to open the door of the vehicle.

In a state where the blocking lever assembly 30 blocks the movement path M of the rotation contact end portion 24 shown in FIG. 6, it is possible to prevent the vehicle door from being unintentionally opened even if the door handle 20 is rotated by an external impact.

Furthermore, when the blocking lever assembly 30 blocks the movement path M of the rotation contact end portion 24 and the door handle 20 does not rotate, the door cannot be opened in the first operation in which an outsider opens the door handle 20. However, the blocking lever assembly 30 may be returned to the setup state. Therefore, in the second operation when an outsider opens the door handle 20, the door may be opened, ensuring the safety of the vehicle occupant.

In an exemplary embodiment of the present invention, the blocking lever 50 is in a shape of "L", wherein a first end portion of the blocking lever 50 includes the inertia portion 32, and wherein the assist lever 34 is slidably mounted in a second end portion of the blocking lever 50.

In an exemplary embodiment of the present invention, the rotation contact end portion 24 is formed obliquely.

In an exemplary embodiment of the present invention, an end portion of the assist lever 34 is formed obliquely.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A structure of preventing door opening in vehicle collision, the structure comprising:

a handle housing including a housing stopper;

a door handle rotatably mounted around a door handle rotation axis on the handle housing, wherein a rotation contact end portion is formed at an end portion of the door handle; and a blocking lever assembly including:

a blocking lever rotatably coupled to the handle housing and having an inertia portion formed on a first end portion of the blocking lever; and an assist lever slidably mounted in a second end portion of the blocking lever and configured of selectively protruding from the second end portion of the blocking lever;

wherein, when the blocking lever assembly is rotated by an external impact applied to the blocking lever assembly, the assist lever protrudes out of the blocking lever to be caught by the housing stopper and positioned in a movement path of the rotation contact end portion.

2. The structure of claim 1, wherein the blocking lever assembly further including a lever spring elastically biasing the blocking lever away from the movement path of the rotation contact end portion.

3. The structure of claim 2, wherein the second end portion of the blocking lever includes a blocking lever protrusion that contacts with the rotation contact end portion when the rotation contact end portion of the door handle presses the assist lever.

4. The structure of claim 2, wherein the rotation contact end portion of the door handle is formed obliquely.

5. The structure of claim 2, wherein an end portion of the assist lever which protrudes out of the second end portion of the blocking lever is formed obliquely.

6. The structure of claim 1, wherein the blocking lever assembly further including a lever spring that rotates the blocking lever assembly when the rotation contact end portion presses the assist lever to move the blocking lever assembly out of the movement path of the rotation contact end portion.

7. The structure of claim 1, wherein the blocking lever assembly further including an assist lever spring for elastically supporting the assist lever in a predetermined direction.

8. The structure of claim 7, wherein the assist lever spring is mounted inside the second end portion of the blocking lever.

9. The structure of claim 1, wherein the second end portion of the blocking lever has a lever insert portion into which the assist lever is slidably mounted to enable the assist lever to move through the lever insert portion.

10. The structure of claim 1, wherein the blocking lever assembly further including an assist lever guide pin, and wherein the assist lever has a guide slot into which the assist lever guide pin connected to the blocking lever is inserted.

11. The structure of claim 1, wherein a blocking stopper is formed on a portion of the blocking lever to limit rotation of the blocking lever assembly in contacting with the handle housing.

12. The structure of claim 1, wherein the blocking lever assembly further including a lever pin rotatably coupling the blocking lever assembly to the handle housing.

13. The structure of claim 1, wherein the blocking lever is in a shape of "L", wherein the first end portion of the blocking lever includes the inertia portion, and wherein the assist lever is slidably mounted in the second end portion of the blocking lever.

* * * * *